United States Patent [19]

Koh et al.

[11] Patent Number: 4,560,415

[45] Date of Patent: Dec. 24, 1985

[54] LIQUID COMPOSITION FOR ARTIFICIAL PRODUCTION OF VERDIGRIS

[75] Inventors: Shiro Koh, Tokyo; Katsuyasu Wada, Hachioji; Kazuhiko Namioka, Hachioji; Masuo Hitomi, Hachioji, all of Japan

[73] Assignees: Dowa Mining Co., Ltd.; Dowa Metal Developping Center Co., Ltd., both of Tokyo, Japan

[21] Appl. No.: 665,785

[22] Filed: Oct. 29, 1984

[30] Foreign Application Priority Data

Nov. 1, 1983 [JP] Japan ..... 58-203620

[51] Int. Cl.[4] ..... C09D 1/00; C04B 31/00

[52] U.S. Cl. ..... 106/286.3; 106/288 B

[58] Field of Search ..... 106/288 B, 286.3; 423/493

[56] References Cited

U.S. PATENT DOCUMENTS 4,038,101 7/1977 Thompson ..... 106/288 B

*Primary Examiner*—Theodore Morris

*Attorney, Agent, or Firm*—Frishauf, Holtz, Goodman & Woodward

[57] ABSTRACT

There is disclosed a liquid composition which is useful for the artificial production of verdigris, said composition comprising an aqueous solution which is acidic due to the presence of free hydrochloric acid and contains an iron salt and a copper salt, said iron and copper salts being dissolved in water in such amounts that dissolved iron is not more than 5.0 g/L and dissolved copper is not more than 20 g/L, said aqueous solution having also dissolved therein at least one alkaline earth metal salt in such an amount that it is effective as a humectant, the total amount of the dissolved iron salt, copper salt and alkaline earth metal salt being in the range of 40–200 g/L and said aqueous solution having a pH of 2.0 or less as measured with a pH meter.

3 Claims, 5 Drawing Figures

LIQUID COMPOSITION FOR ARTIFICIAL PRODUCTION OF VERDIGRIS

FIELD OF THE INVENTION

The present invention relates to a liquid composition for artificially producing a stable film of verdigris on the surface of copper or copper alloy products.

Copper and its alloys, if they are exposed to the atmosphere for an extended period, form a thin film of verdigris (basic salts of copper) on the surface as a result of attack of oxygen, carbon dioxide and water vapor in the atmosphere. The reaction of the verdigris formation is so low that it takes at least about ten years for its completion as is shown in the case of patinated roofs of temples and shrines. Naturally occurring verdigris is both beautiful and sublime. However, as air pollution becomes extensive in urban areas, it is increasingly difficult to form beautiful verdigris under natural conditions.

Various studies have been conducted with a view to producing verdigris artificially. Particular efforts have been made to develop solutions capable of producing artificial verdigris, but none have proved to be suitable for commercial use. One major problem is that the existing verdigris forming liquids contain toxic or harmful chemicals. For example, Japanese Patent Publication No. 9243-1972 proposes the formation of copper amalgam from a solution containing mercuric chloride. Another method that has been proposed to date is by using a solution having arsenious acid dissolved therein. However, mercuric chloride and arsenious acid are very dangerous and solutions containing them can certainly not be used on an industrial scale without causing the problem of environmental pollution, although they could be used for the purpose of patinating articraft. It has also been proposed to form artificial verdigris by using a solution of complex composition, or by anodization with an electric current, or by providing a composite layer with a resin. However, these methods have one problem or another with respect to the ease of handling or stability of a verdigris film, so they cannot be used extensively in industrial applications such as construction fields where the patination of roofings is desired.

BRIEF DESCRIPTION OF THE INVENTION

The present invention has been accomplished with a view to developing a new solution that is capable of easily producing a stable verdigris film from which no deleterious substance will dissolve out. This object can be achieved by a liquid composition comprising an aqueous solution of an iron salt and a copper salt which is acidic due to the presence of free hydrochloric acid, said iron and copper salts being dissolved in water in such amounts that dissolved iron is not more than 5.0 g/L and dissolved copper is not more than 20 g/L, said aqueous solution having also dissolved therein at least one alkaline earth metal salt in such an amount that is effective as a humectant, the total amount of the iron salt, copper salt and alkaline earth metal salt dissolved being in the range of 40–200 g/L and said aqueous solution having a pH of 2.0 or less as measured with a pH meter.

While the properties of the verdigris film produced from the liquid composition of the present invention will be described in detail in the Examples later in this specification, it should be emphasized here that the basic theory behind the present invention is that the claimed liquid composition causes the oxidation and reduction of iron in the presence of an alkaline earth metal chloride as a humectant. A preferred alkaline earth metal salt used as humectant is calcium chloride or magnesium chloride. A preferred iron salt is ferrous or ferric chloride, and a preferred copper salt is cupric chloride.

The respective amount of the iron salt, copper salt and alkaline earth metal salt dissolved in the liquid composition of the present invention should be controlled to be within the proper ranges for the purpose of producing a stable, rugged and beautiful verdigris film on the surface of copper or copper alloy products. It is also necessary that the total amount of the three salts be within the range of 40–200 g/L, preferably 60–150 g/L. If the total amount of the three salts is less than 40 g/L, a rather pale verdigris film forms and its adhesion to the copper or copper alloy substrate is poor. If, on the other hand, the total amount of the three salts is more than 200 g/L, a turbid verdigris film occurs.

Even the color of naturally occurring verdigris differs considerably depending upon the environment and conditions for verdigris formation which determine the amounts of the color-forming salts that are produced in the process of verdigris development. In the color testing conducted to determine the effectiveness of the liquid composition of the present invention, a standard (STD) solution containing 10 g Cu/L, 2.5 g Fe/L and 30 g Ca/L and which was adjusted to a pH of 1.7 by a pH meter was prepared and the color of this STD solution which was found to be within the color spectrum of natural verdigris was used as the standard color. All the verdigris forming solutions prepared in the test were checked for their color against this standard color.

DETAILED DESCRIPTION OF THE INVENTION

Figure 1:
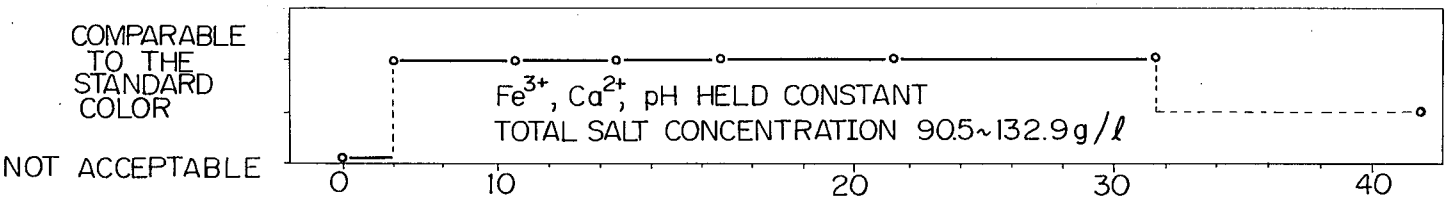
FIG. 1 shows the relation between the color of a verdigris film and the concentration of $CuCl_2$ in the liquid composition of the present invention.

FIG. 1 shows the relation between the concentration of $CuCl_2$ and the color of verdigris film formed when solution samples containing varying amounts of $CuCl_2$ were sprayed onto a copper plate and dried with air. The solution samples had $Fe^{3+}$ and $Ca^{2+}$ concentrations and pH value which were held constant within the ranges defined in this specification. The total concentration of the Fe, Cu and Ca salts was in the range of 90.5–132.9 g/L. As FIG. 1 shows, the concentration of Cu has a great influence on the formation of a desired verdigris film, and must not exceed 20 g/L. The Cu concentration preferably ranges from 1 to 15 g/L, more preferably from 5 to 10 g/L. If the Cu concentration is too low, a pale verdigris film forms and in a very small amount at that. As will be apparent from FIG. 1, $CuCl_2$ selected as a copper salt is preferably dissolved in solution in an amount of 2–32 g/L.

Figure 2:
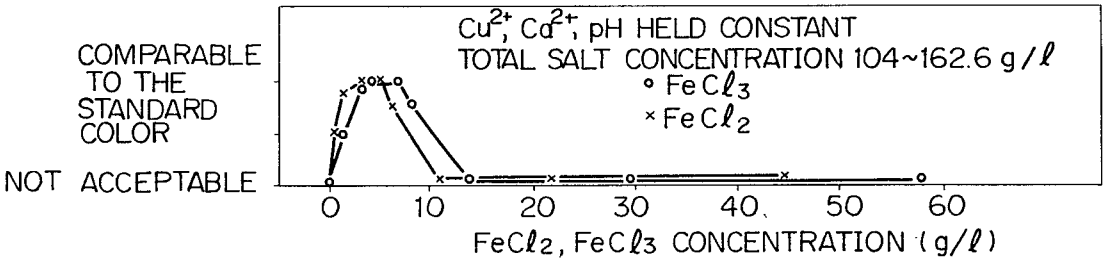
FIG. 2 shows the relation of the color of a verdigris film with the concentrations of $FeCl_2$ and $FeCl_3$ in the liquid composition of the present invention.

FIG. 2 shows the relation between the concentration of $FeCl_2$ (or $FeCl_3$) and the color of verdigris film formed when solution samples containing varying amounts of $FeCl_2$ (or $FeCl_3$) were sprayed onto a copper plate and dried with air. The solution samples had $Cu^{2+}$ and $Ca^{2+}$ concentrations and pH value which were held constant within the ranges defined in the specification. The total concentration of Cu, Ca and Fe salts was in the range of 104–162.6 g/L. As shown in FIG. 2, the presence of a suitable amount of Fe ion is essential for verdigris formation. The suitable amount of Fe ion is 5 g/L or less, with the range of 0.5–2.5 g/L being preferred. If $FeCl_2$ and or $FeCl_3$ is dissolved in solution, the total amount of these salts is preferably in the range of 1.5–7.3 g/L.

Figure 3:
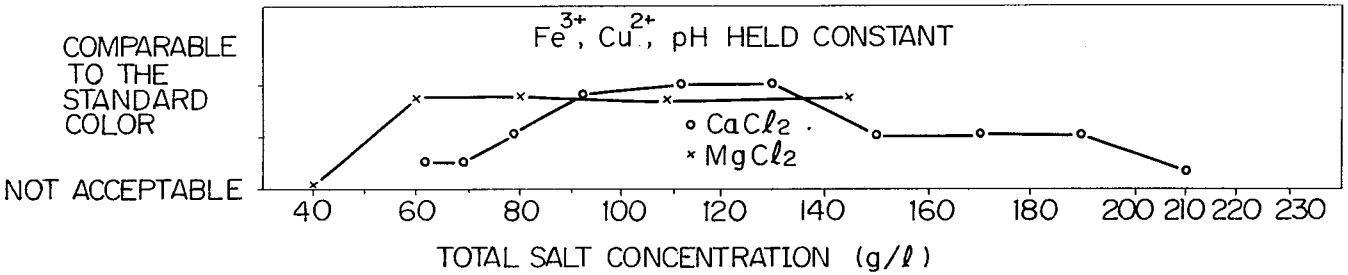
FIG. 3 shows the relation between the color of a verdigris film and the total amount of Fe, Cu and alkaline earth metal salts in the liquid composition of the present invention.

FIG. 3 shows the relation between the concentration of $CaCl_2$ (or $MgCl_2$) and the color verdigris film formed when solution samples containing varying amounts of $CaCl_2$ (or $MgCl_2$) were sprayed onto a copper plate and dried with air. The solution samples had $Fe^{3+}$ and $Cu^{2+}$ concentrations and pH value which were held constant within the ranges defined in the specification. It is clear from FIG. 3 that the total amount of Fe, Cu and alkaline earth metal salts should be within the range of 40–200 g/L, preferably from 50–150 g/L.

Figure 4:
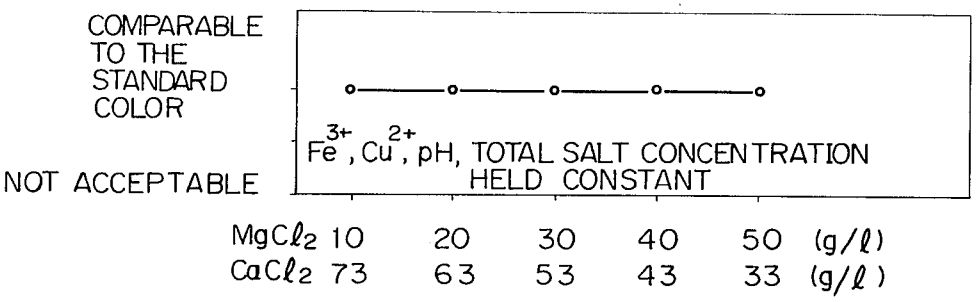
FIG. 4 shows the relation of the color of a verdigris film with the concentrations of $CaCl_2$ and $MgCl_2$ in the liquid composition of the present invention.
Figure 5:
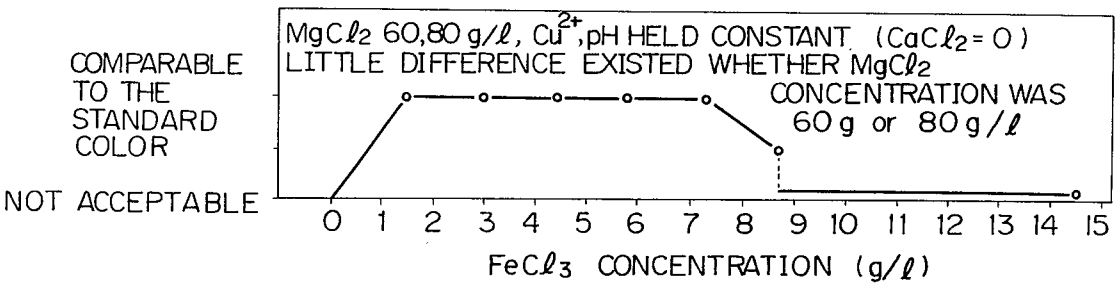
FIG. 5 shows the relation between the color of a verdigris film and the concentration of $FeCl_3$ in the liquid composition of the present invention.

FIG. 4 shows the relation between the combined amount of $CaCl_2$ and $MgCl_2$ and the color of verdigris film. FIG. 5 shows how the amount of $MgCl_2$ influences the concentration of $FeCl_3$ in relation to the color of verdigris film. FIG. 4 makes it clear that $CaCl_2$ and $MgCl_2$ may be used in combination as alkaline earth metal salts that serve the purpose of a humectant. The contribution of $MgCl_2$ to verdigris formation is obvious from FIG. 5. FIGS. 3 and 4 show that in order to produce the desired verdigris film, calcium chloride and magnesium chloride are preferably dissolved in solution in respective amounts of 70–120 g/L and 10–80 g/L.

The pH of the liquid composition of the present invention must be adjusted to 2.0 or below as measured with a pH meter at room temperature. This may be accomplished by addition of hydrochloric acid. If the pH of the liquid composition exceeds 2.0, a precipitate will come out of solution and the composition of the solution can no longer be held at the predetermined level. It is not necessarily needed to increase the addition of acid until the pH drops below 1.5, and excessive acidity will increase the difficulty in handling the liquid composition.

In summary, preferred embodiments of the liquid composition according to the present invention include an aqueous solution containing 1.5–7.3 g/L of ferric chloride, 2–32 g/L of cupric chloride and 70–120 g/L of calcium chloride and which is adjusted to a pH of 2.0 or below with hydrochloric acid, and an aqueous solution containing 1.5–7.3 g/L of ferric chloride, 2–32 g/L of cupric chloride and 10–80 g/L of magnesium chloride and which is adjusted to a pH of 2.0 or below with hydrochloric acid. If both calcium chloride and magnesium chloride are used, part of calcium chloride whose concentration is within the range of 70–120 g/L is replaced by magnesium chloride in a $CaCl_2/MgCl_2$ ratio of approximately 1.5. Alternatively, part of magnesium chloride whose concentration is within the range of 10–80 g/L may be replaced by calcium chloride in a $CaCl_2/MgCl_2$ ratio of approximately 1.5. In either case, the resulting solution is adjusted to a pH of 2.0 or less with hydrochloric acid.

A convenient method of producing artificially a verdigris film on the surface of a copper or copper alloy product is by first spraying said product with the solution prepared above according to the present invention and then allowing the sprayed solution to dry with air. By this procedure, a very stable and beautiful film of verdigris forms uniformly on the surface of a copper or copper alloy product.

The exact mechanism by which a verdigris film forms on the surface of a copper or copper alloy product by application of the aqueous solution of the present invention has not been fully unravelled. A plausible explanation will be as follows: after being sprayed onto the copper surface, the aqueous solution of the present invention is dried, and as a result of evaporation of water, the dissolved components of the solution are concentrated to permit Cu or Fe ions to attack the copper surface. The corrosion of the copper surface by Cu or Fe ions was verified by an experiment which was conducted as follows. A copper plate that had been recrystallized by 30-minute annealing at 600° C. was sprayed with the STD solution of the present invention (21.17 g $CuCl_2$/L, 7.27 g $FeCl_3$/L, 83.25 g $CaCl_2$/L, pH: 1.7) and held at room temperature for 48 hours. An optical micrograph of the surface of the so treated copper plate is shown in Reference Photo 1 attached hereto. Corrosion was found to have occurred at the grain boundaries of copper crystals.

The corrosion of the copper surface by Cu or Fe ions would occur by the reducing reactions indicated below:

$$Cu^{2+} + Cu \rightarrow 2Cu^{+}$$

$$Fe^{3+} + Cu \rightarrow Fe^{2+} + Cu^{+}.$$

The resulting $Fe^{2+}$ is oxidized to $Fe^{3+}$ by aerial oxygen, and $Fe^{3+}$ is again reduced to $Fe^{2+}$, thus repeating the cycle of iron reduction and oxidation. The $Cu^{+}$ on the ionized copper plate is oxidized to $Cu^{2+}$, and as the amount of $Cu^{2+}$ increases, copper hydroxide forms by the reaction shown below:

$$Cu^{2+} + 2OH \rightarrow Cu(OH)_2.$$

The resulting $Cu(OH)_2$ is believed to combine with $CuCl_2$ in the aqueous solution so as to cause the gradual formation of $CuCl_2 \cdot 3Cu(OH)_2$, i.e., a basic copper chloride as a verdigris component.

Therefore, the Fe ion in the aqueous solution of the present invention is assumed not only to contribute to the formation of verdigris by participating in the oxidation-reduction reaction of the system concerned, but also to stabilize the color of verdigris which would otherwise change subtly. However, if the concentration of Fe ion is excessively high (>5 g/L), a verdigris film having a mottled appearance will form. Calcium chloride, another component in the aqueous solution, is converted to calcium hydrochloride in the process of verdigris formation and works effectively in providing a strong adhesion between the verdigris film and the copper substrate. This calcium hydrochloride is colorless and will in no way affect the color of the verdigris film. Calcium chloride and magnesium chloride are highly deliquescent and have the ability to retain water on the copper substrate; therefore, these two compounds function as humectants that hold the necessary water throughout the reaction for the verdigris formation.

The advantages of the liquid composition of the present invention in the formation of an artificial verdigris film will become apparent by reading the following Examples. In the Examples, evaluation of the color of verdigris films formed and the testing of their adhesion to the copper substrate upon bending were conducted by the following methods.

Color determination

Closeness to the standard color of verdigris (the color of naturally occurring verdigris: 100%) was used as the criterion according to the following rating indices:

◎: ≧90%
o: ≧70%
Δ: ≧50%
x: <50%.

Color shades

The difference in color shade from the standard color of verdigris is described verbally.

Bending test

A copper plate (0.3 $mm^T \times 50\ mm^W \times 100\ mm^L$) was sprayed with a sample of verdigris forming liquid composition and left to stand for one week. One corner of the rectangular copper plate was bent 180° and the triangle forming on the bent corner was pounded with a wooden hammer as the plate was put on a wooden block. The bent corner was brought into its initial flat state and the verdigris film on the fold line was checked for its adhesion to the copper substrate.

Criteria for the adhesion of verdigris film

◎: Part of the verdigris film on the fold line separated from the Cu substrate to expose the latter as black spots, but the remainder of the verdigris film strongly adhered to the Cu substrate.

o: The verdigris film on the fold line separated completely from the Cu substrate, but the film on both sides of the fold line strongly adhered to the substrate.

x: The verdigris film on the triangular area of the bent corner separated from the Cu substrate almost completely.

EXAMPLE 1

The purpose of this Example was to demonstrate the criticality of calcium chloride as a humectant.

Metered amounts of $FeCl_3 \cdot 6H_2O$ (12.1 g) and $CuCl_2 \cdot 2H_2O$ (26.8 g) were dissolved in water (1,000 ml). The resulting solution had Fe and Cu concentrations of 2.5 g/L and 10 g/L, respectively. This solution was divided into 8 portions each weighing 100 cc. Varying amounts of $CaCl_2$ (see Table 1 below) were added to the respective sample solutions to give the Ca concentrations listed in Table 1. Each sample solution was mixed with dipping HCl until its pH was 1.7 on the reading of a pH meter.

TABLE 1

| Sample No. | Liquid composition (g/L) Fe | Cu | Ca | $CaCl_2$ | Total amount of Fe, Cu and Ca salts |
|---|---|---|---|---|---|
| 1-1 | 2.5 | 10 | 5 | 1.39 | 42.4 |

TABLE 1-continued

| Sample No. | Liquid composition (g/L) Fe | Cu | Ca | $CaCl_2$ | Total amount of Fe, Cu and Ca salts |
|---|---|---|---|---|---|
| 1-2 | 2.5 | 10 | 15 | 4.16 | 70.1 |
| 1-3 | 2.5 | 10 | 30 | 8.33 | 111.7 |
| 1-4 | 2.5 | 10 | 37 | 10.24 | 130.9 |
| 1-5 | 2.5 | 10 | 44 | 12.22 | 150.7 |
| 1-6 | 2.5 | 10 | 51 | 14.16 | 170.0 |
| 1-7 | 2.5 | 10 | 58 | 16.10 | 189.5 |
| 1-8 | 2.5 | 10 | 65 | 18.07 | 208.9 |

Each of the test samples listed in Table 1 was sprayed onto a fresh copper plate that had been coated with a layer of corrosion inhibitor. (In this Example and the subsequent Examples, all the copper plates that were used as the substrate for the formation of verdigris films measured 0.3 mm thick, 50 mm wide and 100 mm long.) The sprayed Cu plate was left to stand for a week and subjected to color analysis and bending test in the manner already described. The results are shown in Table 2.

TABLE 2

| Sample No. | Color: Evaluation | Color shades | Bending test result |
|---|---|---|---|
| 1-1 | x | predominantly yellowish | x |
| 1-2 | Δ | predominantly yellowish green | o |
| 1-3 | ◎ | somewhat deficient in whiteness | ◎ |
| 1-4 | ◎ | somewhat deficient in whiteness | ◎ |
| 1-5 | ◎ | somewhat deficient in brightness | ◎ |
| 1-6 | o | with some black shade | o |
| 1-7 | o | with some black shade | o |
| 1-8 | Δ | blackened | o |

The same tests were conducted with copper plates that were washed with a neutral detergent to remove the precoat of corrosion inhibitor. Test sample Nos. 1-2 to 1-7 developed a color faster on the plates with no inhibitor coat than on the plates with the inhibitor coat, but there was no substantial difference in respect of the color of verdigris films formed and their adhesion to the Cu substrate. Therefore, in the subsequent Examples, only Cu plates that had an inhibitor coat were used as substrates for verdigris film production.

EXAMPLE 2

A solution having the same composition as that of sample Nos. 1-3 shown in Table 1 was prepared and diluted 1.2 and 1.4 folds to make sample Nos. 2-1 and 2-2 having the compositions listed in Table 3. They were sprayed onto Cu plates as in Example 1 to form a verdigris film. Color analysis and bending test were also conducted as in Example 1, and the results are shown in Table 4.

TABLE 3

| Sample No. | Liquid composition (g/L) Fe | Cu | Ca | $CaCl_2$ | Total amount of Fe, Cu and Ca salts |
|---|---|---|---|---|---|
| 1-3 | 2.5 | 10 | 30 | 8.33 | 111.7 |
| 2-1 | 2.08 | 8.3 | 25 | 6.94 | 93.1 |

TABLE 3-continued

| Sample No. | Liquid composition (g/L) Fe | Cu | Ca | $CaCl_2$ | Total amount of Fe, Cu and Ca salts |
|---|---|---|---|---|---|
| 2-2 | 1.78 | 7.1 | 21.4 | 5.95 | 80.0 |

TABLE 4

| Sample No. | Color Evaluation | Color shades | Bending test result |
|---|---|---|---|
| 1-3 | ⊙ | somewhat deficient in whiteness | ⊙ |
| 2-1 | o | somewhat deficient in blueness | o |
| 2-2 | Δ | deficient in blueness | o |

The above data of Examples 1 and 2 show that a verdigris film of very good quality could be obtained from the liquid compositions according to the present invention. In view of the results of the color analysis and bending tests, the upper limit for the total amount of Fe, Cu and Ca salts (Ca as $CaCl_2$) is about 200 g/L, preferably 150 g/L. The lower limit for the total amount of these three salts is 70 g/L, preferably 90 g/L.

EXAMPLE 3

Liquid compositions having varying $MgCl_2$ concentrations as shown in Table 5 were prepared. The same tests were conducted with these samples as in Example 1. The results are shown in Table 6. Since magnesium chloride is more deliquescent than calcium chloride, the effect of drying period was also examined in Example 3. The data in Table 6 shows that a verdigris film of good quality could also be formed from the liquid composition of the present invention using magnesium chloride as a humectant. Since prolonged drying is not desired for practical purposes, no strict test was conducted to determine the upper limit of the total amount of Fe, Cu and Mg salts. However, it could be said that a preferred range is 60–100 g/L.

TABLE 5

| Sample No. | Liquid composition (g/L) Fe | Cu | Mg | Total amount of Fe, Cu and Mg salts |
|---|---|---|---|---|
| 3-1 | 2.5 | 10 | 2.95 | 40.0 |
| 3-2 | 2.5 | 10 | 8.06 | 60.0 |
| 3-3 | 2.5 | 10 | 13.17 | 80.0 |
| 3-4 | 2.5 | 10 | 20.00 | 106.9 |
| 3-5 | 2.5 | 10 | 30.22 | 146.9 |

TABLE 6

| Sample No. | Color Evaluation | Color shades | Bending test Result | Drying period (days) |
|---|---|---|---|---|
| 3-1 | Δ | deficient in blueness | o | 3 |
| 3-2 | o | strong yellowish shade | ⊙ | 5 |
| 3-3 | o | " | ⊙ | 5 |
| 3-4 | o | " | o | 7 |
| 3-5 | o | " | o | 10 |

EXAMPLE 4

Liquid compositions prepared by using a combination of $CaCl_2$ and $MgCl_2$ as salts of alkaline earth metals and having varying concentrations of said salts as shown in Table 7 were prepared in the same manner as in Example 1 and the same tests as in Example 1 were conducted with these samples. The results are shown in Table 8.

TABLE 7

| Sample No. | Liquid composition (g/L) Fe | Cu | Ca | Mg | Total amount of Fe, Cu, Ca and Mg salts |
|---|---|---|---|---|---|
| 4-1 | 2.5 | 10 | 26.5 | 2.6 | 111.7 |
| 4-2 | 2.5 | 10 | 22.8 | 5.1 | 111.7 |
| 4-3 | 2.5 | 10 | 19.2 | 7.7 | 111.7 |
| 4-4 | 2.5 | 10 | 15.5 | 10.2 | 111.7 |
| 4-5 | 2.5 | 10 | 11.9 | 12.8 | 111.7 |

TABLE 8

| Sample No. | Color Evaluation | Color shades | Bending test Result |
|---|---|---|---|
| 4-1 | o | strong yellowish shade | o |
| 4-2 | o | " | o |
| 4-3 | o | " | o |
| 4-4 | o | " | o |
| 4-5 | o | " | o |

EXAMPLE 5

This Example will illustrate the effect of the Fe concentration on the quality of verdigris film. Since sample No. 1-3 (STD solution) performed well in Example 1, it was selected as a base sample for Example 5 and its Fe concentration was varied from 0 to 10 g/L as listed in Table 9. The iron source was $FeCl_3$, and the Ca and Cu concentrations were held constant at 30 g/L and 10 g/L, respectively. Sample Nos. 5-1 to 5-4 having Fe concentrations below 5.0 g/L were mixed with dripping HCl to reduce their pH levels to 1.7. Sample Nos. 5-5 and 5-6 with Fe concentrations of 5.0 g/L and 10 g/L had pH values below 1.7, so they were immediately used as a spraying solution without the addition of HCl. The color shades of the verdigris films formed and their adhesion to the Cu substrate upon bending are shown in Table 10.

As is clear from Table 10, the adhesion of verdigris films to the Cu substrate was not greatly affected by the Fe concentration. However, the shade in the color of the verdigris films was highly dependent on the Fe concentration, and sample solutions having high Fe concentrations were yellowish and had a darker shade.

With the Ca and Cu concentrations used in Example 5, the Fe level in the range of 1.0–2.5 g/L would produce the best results.

TABLE 9

| Sample No. | Liquid composition (g/L) Cu | Ca | Fe | Total amount of Cu, Ca and Fe salts |
|---|---|---|---|---|
| 1-3 | 10 | 30 | 2.5 | 111.7 |
| 5-1 | 10 | 30 | 0 | 104.4 |
| 5-2 | 10 | 30 | 0.5 | 105.9 |
| 5-3 | 10 | 30 | 1.0 | 107.3 |
| 5-4 | 10 | 30 | 1.5 | 108.8 |
| 5-5 | 10 | 30 | 5.0 | 119.0 |
| 5-6 | 10 | 30 | 10.0 | 133.5 |

TABLE 10

| Sample No. | Color Evaluation | Color shades | Bending test Result |
|---|---|---|---|
| 1-3 | ⊙ | somewhat deficient in whiteness | ⊙ |
| 5-1 | o | strong bluish shade but no yellowish shade | o |
| 5-2 | o | strong bluish shade but no yellowish shade | o |
| 5-3 | ⊙ | strong bluish shade | ⊙ |
| 5-4 | ⊙ | strong bluish shade | ⊙ |
| 5-5 | o | with some black shade | o |
| 5-6 | x | blackened | o |

EXAMPLE 6

The same experiment was conducted as in Example 5 except that $FeCl_3$ was replaced by ferrous chloride, $FeCl_2$. The liquid compositions used and the test results obtained are respectively shown in Tables 11 and 12.

TABLE 11

| Sample No. | Liquid composition (g/L) Cu | Ca | Fe | Total amount of Cu, Ca and Fe salts |
|---|---|---|---|---|
| 6-1 | 10 | 30 | 0 | 104.4 |
| 6-2 | 10 | 30 | 0.5 | 105.6 |
| 6-3 | 10 | 30 | 1.0 | 106.7 |
| 6-4 | 10 | 30 | 1.5 | 107.8 |
| 6-5 | 10 | 30 | 2.5 | 110.1 |
| 6-6 | 10 | 30 | 5.0 | 115.8 |
| 6-7 | 10 | 30 | 10.0 | 127.1 |

TABLE 12

| Sample No. | Color Evaluation | Color shades | Bending test Result |
|---|---|---|---|
| 6-1 | o | strong bluish shade but no yellowish shade | o |
| 6-2 | o | strong bluish shade but no yellowish shade | o |
| 6-3 | o | strong bluish shade but no yellowish shade | o |
| 6-4 | ⊙ | comparable to sample No. 1-3 | ⊙ |
| 6-5 | ⊙ | strong yellowish shade | ⊙ |
| 6-6 | o | weak bluish shade | o |
| 6-7 | x | no bluish shade, yellow shade was predominant | o |

All the sample solutions as prepared by using $FeCl_2$ had pH values higher than 2.0 and were mixed with dripping HCl to adjust their pH to 1.7.

As is clear from the comparison between the results of Examples 5 and 6, no substantial difference occurred whether the iron salt used was $FeCl_3$ or $FeCl_2$. The only difference was that the verdigris films formed from the solutions using $FeCl_2$ (Example 6) had a somewhat stronger yellowish shade than those formed in Example 5 using $FeCl_3$. The colored crystal grains formed in Example 6 were somewhat smaller and more uniform in size than those formed in Example 5. This would be the reason why the verdigris films formed in Example 6 adhered more strongly to the Cu substrate than in Example 5.

When $FeCl_2$ is used as the iron salt, $Fe^{2+}$ is oxidized to $Fe^{3+}$ by aerial oxygen and only thereafter would the reaction of copper corrosion take place by the following reaction: $2Fe^{3+}+Cu \rightarrow 2Fe^{2+}+Cu^{2+}$. This aerial oxidation step does not delay the start of the formation of a verdigris film as compared with the case of using $FeCl_3$ as the iron salt since the spraying solution provides an ample supply of $Cu^{2+}$ ions.

EXAMPLE 7

The purpose of this Example is to illustrate the effect of the Cu concentration on the quality of verdigris film. Sample No. 1-3 which performed well in Example 1 was selected as a base solution for Example 7 and its Cu concentration was varied from 0 to 20 g/L as shown in Table 13. The Cu source was $CuCl_2 \cdot 2H_2O$ and the Ca and Fe concentrations were held constant at 30 g/L and 2.5 g/L, respectively. All samples were adjusted to a pH of 1.7 by addition of HCl. Verdigris films were formed on Cu plates by spraying the sample solutions as in Example 1. The color shades of the verdigris films formed and their adhesion to the Cu substrate upon bending are shown in Table 14.

TABLE 13

| Sample No. | Liquid composition (g/L) Fe | Ca | Cu | Total amount of Fe, Ca and Cu salts |
|---|---|---|---|---|
| 1-3 | 2.5 | 30 | 10.0 | 111.7 |
| 7-1 | 2.5 | 30 | 0 | 90.5 |
| 7-2 | 2.5 | 30 | 1.0 | 92.6 |
| 7-3 | 2.5 | 30 | 3.0 | 96.9 |
| 7-4 | 2.5 | 30 | 5.0 | 101.1 |
| 7-5 | 2.5 | 30 | 7.0 | 105.3 |
| 7-6 | 2.5 | 30 | 10.0 | 111.7 |
| 7-7 | 2.5 | 30 | 15.0 | 122.3 |
| 7-8 | 2.5 | 30 | 20.0 | 132.9 |

TABLE 14

| Sample No. | Color Evaluation | Color shades | Bending test Result |
|---|---|---|---|
| 1-3 | ⊙ | same as in Example 1 | ⊙ |
| 7-1 | x | very slight film (of verdigris) formation, with strong yellowish shade | x |
| 7-2 | ⊙ | slow film formation, somewhat strong yellowish shade | o |
| 7-3 | ⊙ | somewhat retarded film formation, somewhat strong yellowish shade | o |
| 7-4 | ⊙ | moderate film formation, with somewhat strong yellowish shade | o |
| 7-5 | ⊙ | moderate film formation, with somewhat strong yellowish shade | ⊙ |
| 7-6 | ⊙ | yellowish shade stronger than sample 1-3 | ⊙ |
| 7-7 | ⊙ | good | ⊙ |
| 7-8 | o | with dark or black shade | ⊙ |

The verdigris films formed from the samples prepared in Example 7 generally had a stronger yellowish shade than those from the samples prepared in Example 1. This is perhaps due to the difference between the weather conditions that prevailed when experiments were conducted in the two Examples. Stated more specifically, the atmosphere for the experiment conducted in Example 7 was more humid than that in Example 1 and this may have caused a rapid precipitation of a basic iron chloride.

According to Table 14, the higher the Cu concentration of the liquid samples, the shorter the time to film (of verdigris) formation. A plausible reason for this would be as follows: after evaporation, Cu in the liquid composition is converted to a basic salt by reaction with oxygen or carbon dioxide carried over from moisture in air, and in order to compensate for this loss of Cu in the liquid composition, Cu is dissolved out of the substrate. This would be the reason why sample No. 7-1 having no Cu present was so slow in the reaction of film formation. It is understood that iron first dissolves Cu out of the substrate and only after the concentration of Cu in the liquid composition is reached to a certain level, does the basic salt of copper come out of solution as a precipitate. Therefore, in consideration of the time to film formation, the lower limit for the Cu concentration of the liquid composition is preferably 5 g/L, whereas the upper limit will be about 20 g/L, preferably 15 g/L, in consideration of the color shade of the verdigris film formed. As far as the data of Example 7 shows, the Cu concentration causes no appreciable effects on the adhesion of the verdigris film to the Cu substrate.

EXAMPLE 8

This Example is given to illustrate the effect of pH of the liquid composition on the quality of verdigris film.

The solution samples as freshly synthesized in Example 5 using ferric chloride as the iron salt had the following readings of a pH meter.

TABLE 15

| Sample No. | pH just after synthesis |
|---|---|
| 5-1 | 3.35 |
| 5-2 | 2.33 |
| 5-3 | 2.12 |
| 5-4 | 1.98 |
| 5-5 | 1.68 |
| 5-6 | 1.40 |

Sample Nos. 5-1 to 5-4 just after synthesis had pH values higher than 1.7, so they were treated with HCl to adjust their pH to 1.7. Sample Nos. 5-5 and 5-6 already having pH values less than 1.7 were immediately sprayed onto Cu plates. The color shades and the adhesive strength of the verdigris films formed from the respective samples were as described in Example 5. As for the coarseness of the surface of the Cu substrate, no substantial difference was found to exist among sample Nos. 5-1 to 5-5 and the Cu plates from which the verdigris films were peeled were roughened only slightly. However, the Cu plate that was coated with the verdigris film formed from sample No. 5-6 had an extensively roughened surface. This suggests that at lower pH levels (high acidity) the rate of dissolution of Cu ions by iron is accelerated by the high acid content. An excessively fast progress of the reaction for verdigris formation is not recommended. Therefore, the lower limit for the pH of the liquid composition would be about 1.5 as measured by a pH meter. The actual concentration of hydrogen ions determined by chemical analysis for sample No. 5-6 having a pH meter reading of 1.4 was considerably higher than the value calculated from pH value by the reading of the pH meter. In actual operations, direct measurement of the concentration of hydrogen ions is very cumbersome and instead, a pH meter is commonly used as a convenient tool.

The effect of high pH levels on the quality of verdigris films was also examined. Sample solutions having the compositions shown in Table 16 were treated with calcium carbonate so that they had a pH of 2.0 as measured with a pH meter. The so treated sample solutions were sprayed onto Cu plates.

TABLE 16

| Sample No. | Liquid composition just after synthesis (g/L) Cu | Fe | Ca | pH just after synthesis |
|---|---|---|---|---|
| 8-1 | 10 | 2.5 | 5 | 1.92 |
| 8-2 | 10 | 2.5 | 15 | 1.90 |
| 8-3 | 10 | 2.5 | 30 | 1.78 |
| 8-4 | 10 | 5.0 | 5 | 1.71 |
| 8-5 | 10 | 5.0 | 15 | 1.70 |
| 8-6 | 10 | 5.0 | 30 | 1.65 |

The results with sample Nos. 8-1 to 8-3 containing 2.5 g Fe/L were almost the same as those obtained in Example 1. The verdigris films formed from sample Nos. 8-4 to 8-6 containing 5.0 g Fe/L were somewhat darker in shade than the verdigris films formed in Example 1 from the samples having the corresponding Ca concentrations. However, there was no substantial difference in the adhesion of verdigris films to the Cu substrate whether the Fe concentration was 2.5 g or 5.0 g/L.

In view of the results shown above, the upper limit for the pH of the liquid composition would be about 2.0 as measured with a pH meter. A particularly preferred level is about 1.7 that was selected for Examples 1 to 7. Liquid solutions having pH values of 2.0 or above on the reading of a pH meter had no problem at the time of their preparation, but thereafter an iron precipitate formed gradually.

EXAMPLE 9

The purpose of this Example is to show the effect of residual sulfate salt on the quality of verdigris films. A sample solution (100 cc) having the same composition as that of sample No. 1-3 was prepared and intimately mixed with 2 g of gypsum under agitation. The mixture was passed through a filter and sprayed onto a Cu plate. The verdigris film formed had color shades and adhesion to the Cu substrate which were the same as those obtained with the verdigris film formed from sample No. 1-3. This indicates that the presence of sulfate salt had no adverse effects on the quality of verdigris film.

The sample solution used in Example 9 was found to contain 346 mg sulfate ions per liter. This may safely be regarded as the amount of sulfuric acid dissolved in the sample solution. Even if sulfuric acid is added to the aqueous solution, it reacts with calcium chloride in the solution to form gypsum, and the amount of gypsum in excess of its solubility limit crystallizes and comes out of solution. The addition of gypsum is equivalent to the addition of sulfuric acid.

EXAMPLE 10

The purpose of this Example is to show the effect of the presence of a halogen on the quality of verdigris film. Three sample solutions (100 cc) each having the same composition as that of sample No. 1-3 were prepared and respectively mixed with calcium fluoride, potassium iodide and bromine water in an amount of 1.0 g/L. Each mixture was sprayed onto a Cu plate. The results were identical to those obtained when no halogen was added.

EXAMPLE 11

The purpose of this Example is to show the effect of using a salt in addition to Fe, Cu and alkaline earth metal salts. A sample solution (100 cc) having the same composition as that of sample No. 2-1 was prepared and intimately mixed with 2.6 g of zinc chloride ($ZnCl_2$) and 2.1 g of NaCl. The mixture was sprayed onto a Cu plate. The mixture had Zn and Na concentrations of 12.4 g/L and 8.2 g/L, respectively, and the total amount of the dissolved salts was 140 g/L. The results were substantially identical to those obtained with sample No. 2-1.

The above data shows that the presence of a small amount of a salt that produces a white crystal upon drying with air causes no effect on the color shade of the verdigris film formed. The adhesion of the verdigris film to the Cu substrate was also not affected by the presence of a small amount of a salt in addition to Fe, Cu and alkaline earth metal salts. In the final state, both calcium and magnesium react with carbon dioxide in air and form a carbonate which is no longer deliquescent. This mechanism will not be inluenced at all in the presence of a small amount of an extraneous salt.

EXAMPLE 12

Three deoxidized copper plates (0.35 $mm^T \times 365$ $mm^W \times 1212$ $mm^L$) were each halved across the length to provide six elongated subunits. The four sides of each subunit were bent to enable subsequent roofing operation. They were placed flat and sprayed with sample solution No. 1-3 (2.5 g Fe/L, 10 g Cu/L, 30 g Ca/L, pH 1.7 on the reading of pH meter) that was ejected from a nozzle positioned obliquely about 1 m above the subunits. The spraying operation consisted of a preliminary spraying by which the subunits were lightly sprayed with the solution and the final spraying that was performed 3 hours after the pre-spraying. The intensity of the final spraying was so adjusted that the entire surface of each subunit was covered with the spray mist. Four days later, the subunit became dry to such an extent that the fingers were no longer wetted by the applied solution. On the 7th day, the subunits were leaned against the wall of the shop, and about one month later, they were assembled by engaging the bent portion of one subunit with that of an adjacent subunit and by clamping the so engaged bent portions with a wooden hammer. The resulting assembly was in the form of a roof tile consisting of six subunits in two columns and three rows. As a result of the pounding with a wooden hammer, the verdigris films separated from bent portions of each subunit and some areas of the copper substrate became exposed. They were somewhat darkened due to corrosion. Upon standing for about 2 months, the areas where the Cu substrate was exposed were also covered with a verdigris film. On the fourth day of the final spraying when no moisture was felt by the fingers, the general shade of the verdigris film was somewhat yellowish. One month later when the clamping operation was effected, a bluish shade became so intense that the initial yellowish shade was covered to give a color that was close to that of naturally occurring verdigris. Three months later, the verdigris film acquired an almost natural color and did not separate from the Cu substrate even when it was pounded with a wooden hammer.

EXAMPLE 13

Three deoxidized copper plates (0.35 $mm^T \times 365$ $mm^W \times 1212$ $mm^L$) were each cut into four equal portions. Six pairs of subunits were provided and the two members of each pair were clamped together on the shorter end. The four sides of each pair were bent to enable subsequent roofing operation. Each pair was sprayed with an aqueous solution as in Example 12. The solution had Fe, Cu, Ca and Mg salts dissolved therein in such amounts that Fe, Cu, Ca and Mg concentrations were 1.5 g/L, 10 g/L, 22 g/L and 5.0 g/L, respectively. The prepared solution was treated with HCl to give a pH reading of 1.7 on a pH meter. Unlike the case of Example 12, only a single spraying operation was conducted by applying the solution lengthwise and crosswise. Five days later, each subunit became dry to the touch of the fingers. On the 7th day, the subunits were leaned against the wall of the shop, and about one month later, the six pairs of subunits were assembled by engaging the bent portion of one pair with that of an adjacent pair and by clamping the so engaged bent portions with a wooden hammer. The three pairs were so arranged that each subunit of one pair staggered from each subunit of an adjacent pair by half its length. The resulting assembly was in the form of a roof tile consisting of six pairs of subunits in two columns and three rows.

The strength of adhesion of the verdigris film to the Cu substrate in the bent portion of each subunit was substantially the same as in the case of Example 12. When the surface of the blue green verdigris film was touched by the finger, a loose white powder adhered to the finger. Upon standing outdoors for about one month, a fresh verdigris film formed on those areas where the Cu substrate was exposed. No loose white powder adhered to the finger by which the surface of the verdigris film was touched. This is perhaps carbonate salts of calcium and magnesium had been washed away by rain. The color of the verdigris film also did not differ greatly from that of the verdigris film formed in Example 12 except that the verdigris film formed in Example 13 was somewhat more bluish than the color of naturally occurring verdigris.

EXAMPLE 14

An alloy consisting of 58% Cu, 38% Zn and 4% Al was melt-cast and rolled to form a 1 mm thick plate. This was heated to 750° C. at which it was held for 1 hour. Subsequently, the plate was water-quenched to produce a martensite structure comprising larger crystal grains.

A commercial copper plate 1 mm thick was rolled to a thickness of 0.3 mm. The rolled plate was heated at 600° C. for 30 minutes to produce a recrystallized structure comprising grains of a size of about 100 μm (an optical micrograph of the surface of this copper plate is shown in Reference Photo 1 attached hereto).

The two plates prepared above were sprayed with sample solution No. 1-3 (2.5 g Fe/L, 10 g Cu/L, 30 g Ca/L, 1.7 on the reading of a pH meter). A verdigris film formed on both plates. The Cu-Zn-Al plate of a martensite structure was more greenish than the recrystallized Cu plate which was darker in shade than the Cu plate that was treated with sample solution No. 1-3 in Example 1.

The recrystallized Cu plate was stripped of the verdigris film and polished on the exposed surface in preparation for taking of an optical micrograph, which is shown in Reference Photo 2. Apparently, the grain boundaries of the crystals were corroded, but the crystal surfaces were not. Since actual copper plates comprise much smaller crystal grains, a Cu substrate which is corroded only at the grain boundaries would provide a sufficient adhesion to the verdigris film.

What is claimed is:

1. A liquid composition for artificial production of verdigris comprising an aqueous solution of an iron salt and a copper salt, said composition being acidic due to the presence of free hydrochloric acid, said iron and copper salts being dissolved in water in such amounts that dissolved iron is not more than 5.0 g/L and dissolved copper is not more than 20 g/L, said aqueous solution having also dissolved therein at least one alkaline earth metal salt in such an amount that it is effective as a humectant, the total amount of the dissolved iron salt, copper salt and alkaline earth metal salt being in the range of 40–200 g/L and said aqueous solution having a pH of 2.0 or less as measured with a pH meter.

2. A liquid composition according to claim 1 wherein said iron salt is ferrous or ferric chloride, said copper salt is cupric chloride and said alkaline earth metal salt is calcium chloride which is dissolved in an amount in the range of 70–120 g/L.

3. A liquid composition according to claim 1 wherein said iron salt is ferrous or ferric chloride, said copper salt is cupric chloride and said alkaline earth metal is magnesium chloride which is dissolved in an amount ranging from 10–80 g/L.

* * * * *